US006811340B2

(12) United States Patent
Petit

(10) Patent No.: US 6,811,340 B2
(45) Date of Patent: Nov. 2, 2004

(54) APPLICATOR WITH ROTARY END AND DISTRIBUTOR COMPRISING OF SAID APPLICATOR

(75) Inventor: Robert Petit, Savigny sur Orge (FR)

(73) Assignee: Techpack International, Chevilly Larue (FR)

( * ) Notice: Subject to any disclaimer, the term of this patent is extended or adjusted under 35 U.S.C. 154(b) by 0 days.

(21) Appl. No.: 10/440,151

(22) Filed: May 19, 2003

(65) Prior Publication Data

US 2004/0028455 A1 Feb. 12, 2004

(30) Foreign Application Priority Data

Jun. 3, 2002 (FR) ..... 02 06798

(51) Int. Cl.[7] ..... A46B 17/08
(52) U.S. Cl. ..... 401/122
(58) Field of Search ..... 401/130, 126, 401/124, 122, 121, 118

(56) References Cited

U.S. PATENT DOCUMENTS 1,962,875 A * 6/1934 Reber ..... 604/1
2,034,416 A 3/1936 Peat et al.
2,860,359 A * 11/1958 James ..... 401/183
4,921,366 A * 5/1990 Hurrell ..... 401/126
5,064,058 A * 11/1991 Hirzel ..... 206/209
5,816,728 A 10/1998 Nardolillo et al.
6,196,743 B1 3/2001 Brucker
6,260,558 B1 7/2001 Neuner
6,280,112 B1 * 8/2001 Vieu ..... 401/122
6,345,626 B1 * 2/2002 Bouix ..... 132/218

FOREIGN PATENT DOCUMENTS

FR 2 753 060 A 3/1998

* cited by examiner

*Primary Examiner*—Gregory L. Huson
*Assistant Examiner*—Huyen Le
(74) *Attorney, Agent, or Firm*—Young & Thompson

(57) ABSTRACT

The distributor of a cosmetic product comprises a body typically forming a reservoir for the product and an applicator. The applicator comprises a longitudinal element with a manual gripping member fixed to its upper end and an element of application of the cosmetic product at its lower end, the application element cooperating with the lower end in rotation, and comprising a member for transferring or temporarily retaining the product. The transfer or temporary retention member comprises a lower end positioned in the axial direction with respect to the lower end of the product, such that the latter does not project beyond the axial level of the lower end of the transfer member.

21 Claims, 5 Drawing Sheets

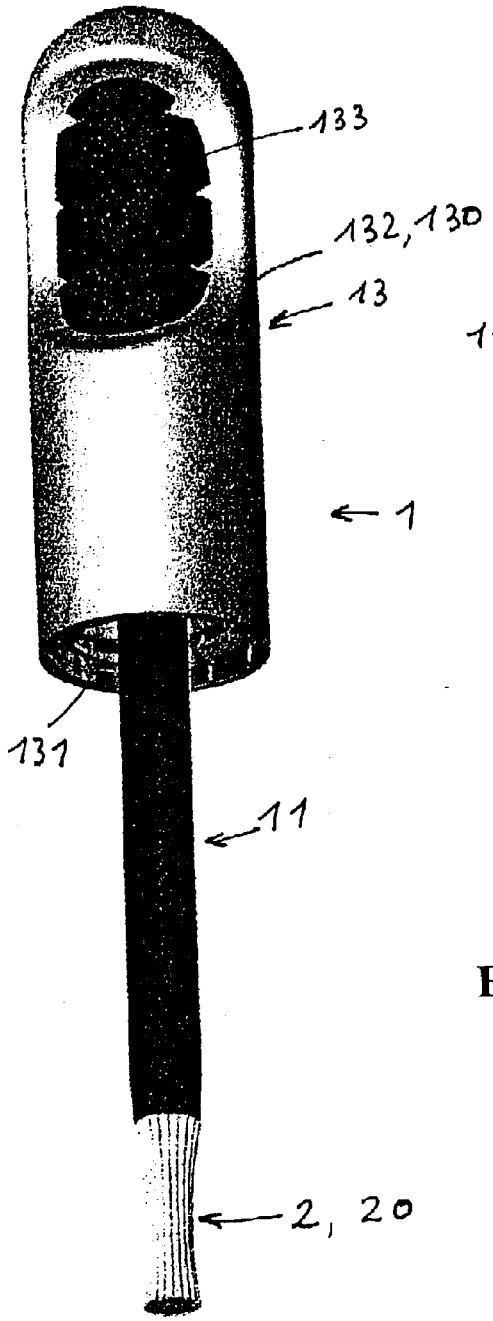
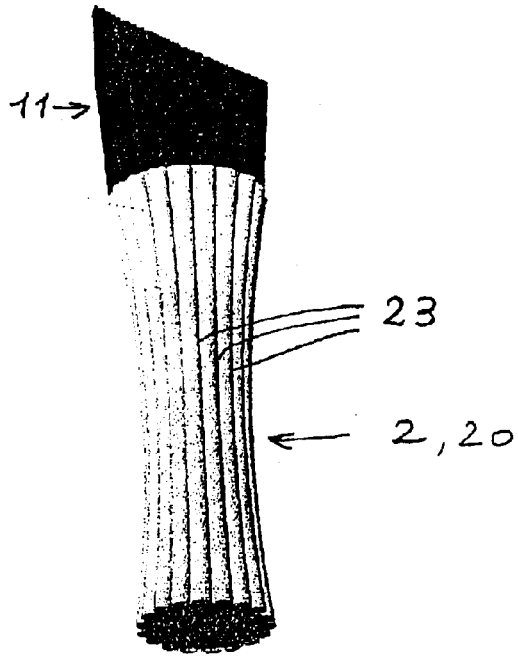
FIG.4b
FIG. 4a

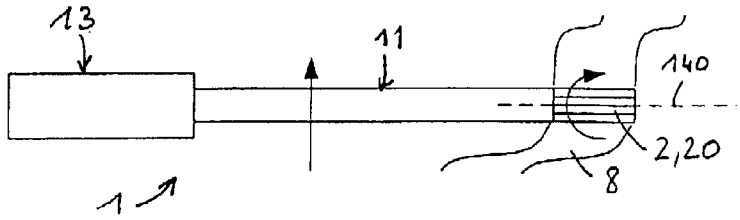
FIG. 5
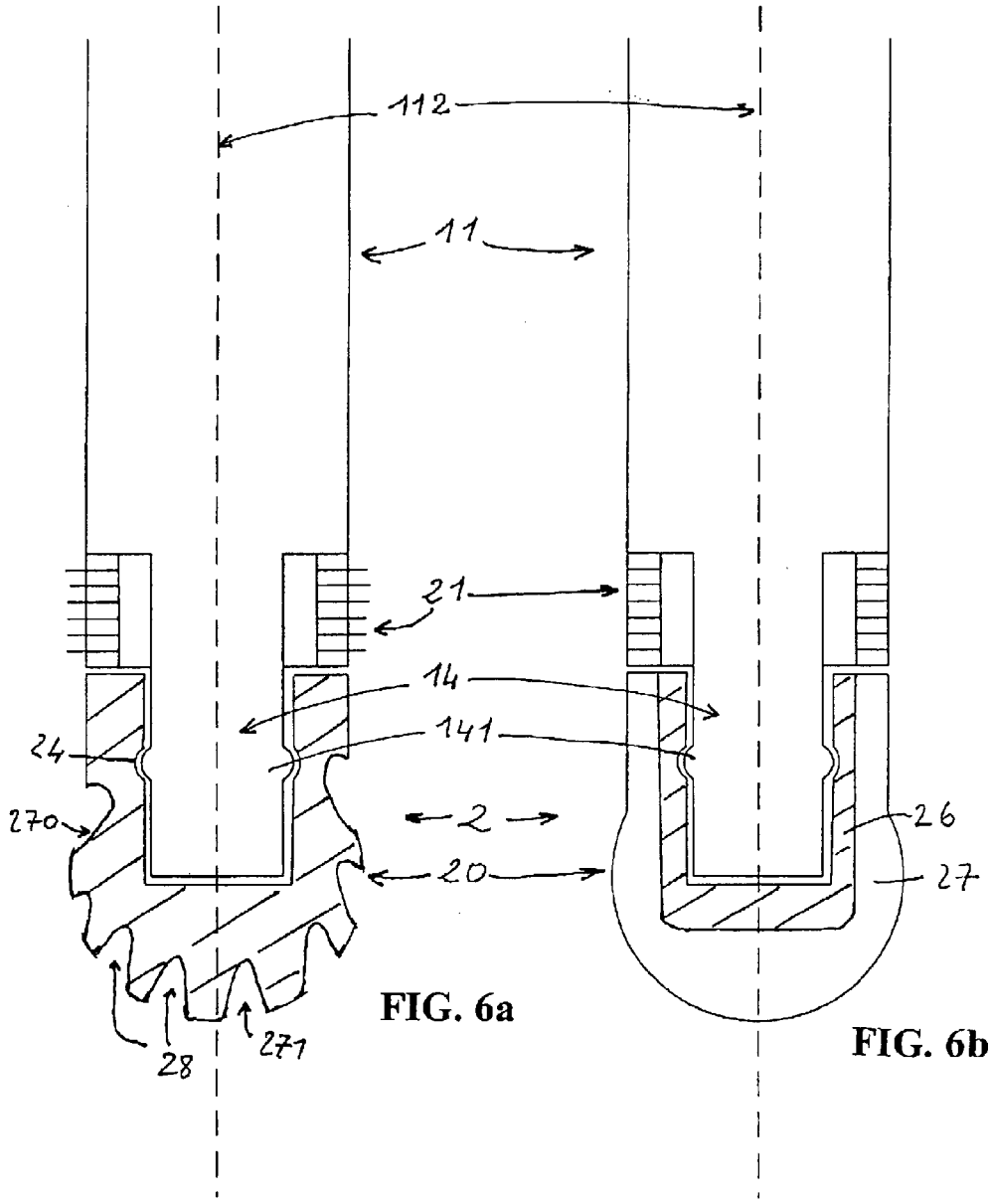
FIG. 6a
FIG. 6b

APPLICATOR WITH ROTARY END AND DISTRIBUTOR COMPRISING OF SAID APPLICATOR

FIELD OF THE INVENTION

The invention relates to the field of distributors that comprise a brush type applicator, etc., to locally deposit a typically fluid product on a support, the product being contained in the said distributor, and to facilitate its application on the said support.

One example application is in the field of cosmetic products for mascara distributors that comprise brush type applicators for applying mascara on eyelashes.

STATE OF THE ART

A large number of typically fluid cosmetic product applicators are known, such as mascara or nail varnish applicators.

These applicators may comprise a brush, for example as described in European application No. 01420042.2.

They may also comprise a flexible element, for example like that described in European application No. 00420175.2.

They may also comprise a brush, for example like that known in the prior art in the case of nail varnish bottles.

U.S. Pat. No. 5,816,728 is also known, that describes a mascara applicator in which the traditional brush has been replaced by several balls capable of rotating about themselves.

U.S. Pat. No. 2,034,416 is also known that describes a liquid applicator, such as a liquid deodorant, comprising a spongy application material capable of rotating about itself.

Problems that Arise

Mascara or nail varnish applicators according to the state of the art typically comprise a gripping means and an application means for transferring the product to be applied onto a support.

As mentioned earlier, these application means according to the state of the art are typically composed of a brush fixed to a manual gripping means, which can also act as a cap for a receptacle containing the product to be applied.

During use, the brush containing the product to be applied is placed on the support (nails, eyelashes, skin, etc.) and moved about the support so as to leave a deposit of the product. It is well known that this type of deposit is not necessarily very homogenous and is frequently striated, as a result of brush translation movements during application of the product.

The mascara applicator described in patent U.S. Pat. No. 5,816,728 has several disadvantages:

- firstly the mascara gets trapped discontinuously between the balls, which cannot result in an application as uniform as is desired,
- secondly, the applicator has a fairly pointed end, and therefore can be unpleasant if not actually dangerous as it comes into contact with the face
- finally, the mascara tends to penetrate between the balls and the central spindle and tends to make the balls stick and prevent them from turning.

The invention is intended to obtain a reliable and therefore smoother and more uniform application of mascara or nail varnish without requiring several passes of the applicator on the support, possibly along different directions.

Furthermore, there is a constant demand for new applicator types, so that a variety of applicators can be offered together with increased differentiation between presentations of cosmetic products, and particularly so that effects that cannot be obtained with applicators according to the state of the art can be obtained.

The purpose of the invention is applicators that solve these problems, while remaining economic to make.

DESCRIPTION OF THE INVENTION

According to the invention, the distributor (9) of a cosmetic product (10) designed to be deposited on a support (8) such as part of the face or finger or toe nails, comprises a body typically forming a reservoir (5) for the said product (10) and an applicator (1). The said applicator (1) comprises a longitudinal element (11, 160) in the axial direction (112), with a manual gripping means (13, 15) fixed to the "upper" end (12) of the said longitudinal element and a means of application (2) of the said cosmetic product (10) fixed to the said longitudinal element at its other "lower" end (14), at least part (20) of the said application means (2) cooperating with the said lower end (14) of the said longitudinal element in rotation, the said part (20) being free to rotate with respect to the said lower end (14), the said mobile part (20) and the said lower end (14) typically cooperating like a "hub" and "spindle" pair, the said part (20) of the said application means (2) typically comprising a means (27) of transferring or temporarily retaining the said product, typically on its surface but possibly in its body and typically working by capillarity, so that manual displacement of the said applicator (1) in order to make a local deposit of the said product on the said support (8) causes rotation of the said mobile part (20) with respect to the said lower end (14) and a transfer of the said cosmetic product (10) on the said support (8), applicator (1) in which the said transfer or temporary retention means (27) comprises a lower end (271) positioned in the axial direction with respect to the said lower end (14), such that the said lower end (14) does not project beyond the axial level of the said lower end (271).

Thus, the applicator according to the invention comprises a mobile part free to move in rotation, such that a manual pressure can be applied on the applicator while moving the applicator in translation without generating a large friction force between the mobile part and the support to be treated. The width of this mobile part may typically be between 5 and 30 mm.

The applicant has compared applicators according to the prior art and applicators according to the invention and has observed that product layers obtained using applicators according to the invention did not have the same appearance as product layers obtained with applicators according to the prior art and were less striated.

The applicant has also observed that it is possible to have applicators with a mobile part without any risk of seizure of the mobile part and that are more comfortable to use, since the fixed part of the applicator can never come into contact with the support or the face.

DESCRIPTION OF THE FIGURES

All the figures are related to distributor applicators (1) according to the invention.

FIGS. 4*a* and 4*b* are perspective views of another applicator embodiment (1), FIG. 4*b* being an enlarged view of the lower end (14) of the applicator (1) comprising the mobile part (20).

FIG. 5 diagrammatically illustrates the use of the applicator (1), in which the mobile part (20) is applied on a support (8) to be treated; displacement of the applicator by translation causes rotation of the said mobile part (20).

FIGS. 6*a* and 6*b* are partial axial sectional views of the lower ends (14) of two applicator embodiments (1) in which the said application means (2) comprise a mobile part (20) and a fixed part (21). In FIG. 6*a*, the fixed part comprises a brush in which the bristles project beyond the alignment formed by the longitudinal element (11) of the applicator, while in FIG. 6*b*, the bristles of the brush are along the centreline of the longitudinal element (11) of the applicator.

DETAILED DESCRIPTION OF THE INVENTION

Figure 1:
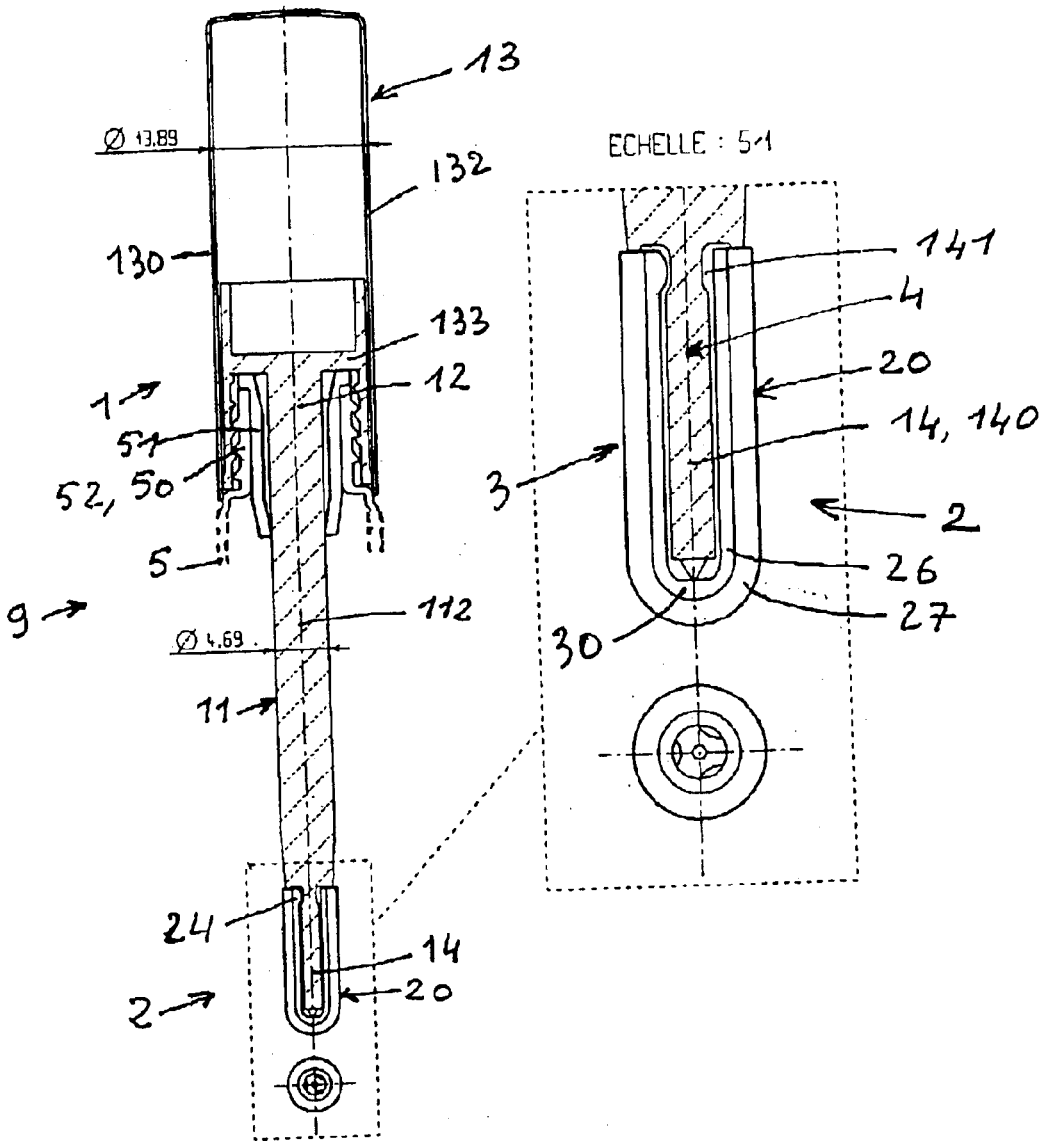
FIGS. 1 to 3 show axial sections through three different embodiments of applicators (1) and distributors (9).

According to a first applicator (1) embodiment according to the invention, the said receptacle may comprise a neck (50), typically provided with a wiping lip (51), the length of the said longitudinal element (11) being adapted to the depth of the said receptacle (5) in order to transfer the said typically fluid product towards the said application means (2), typically when the said neck (50) of the said receptacle (5) is closed off by the said cap (13).

FIGS. 1 to 4*b* illustrate applicators (1) belonging to this family.

As shown in these figures, the said cap (13) may comprise a skirt (130) cooperating with the said neck (50) by screwing or click fitting using a screwing thread or a click fit rib or groove (131, 52).

According to a second family of applicators (1) according to the invention, the said manual gripping means may form a reservoir (15) for the said product (10) in which the said longitudinal element (160) comprises a pipe (164) opening up into the said reservoir so as to supply product (10) to the said application means (2) through a manual transfer means, the said body typically forming a case or a jacket (7) that protects the said longitudinal element (160) and the said application means (2), and forms a cavity (73) that may enable transfer of a predetermined and limited quantity of the said product (10) from the said reservoir (15) to the said application means (2).

Thus, the said reservoir (15) may comprise an outer shell (150) containing the said product, typically with a cylindrical shape, the said shell (150) comprising an opening closed off by an insert (16) fixed to the said longitudinal element and forming a piston for the said shell (150), the said insert cooperating in a fixed manner with the said case (7), typically through its neck (70) so as to form the said manual transfer means by manual displacement of the said longitudinal element (160) of the said case (7) in the axial direction.

Figure 7:
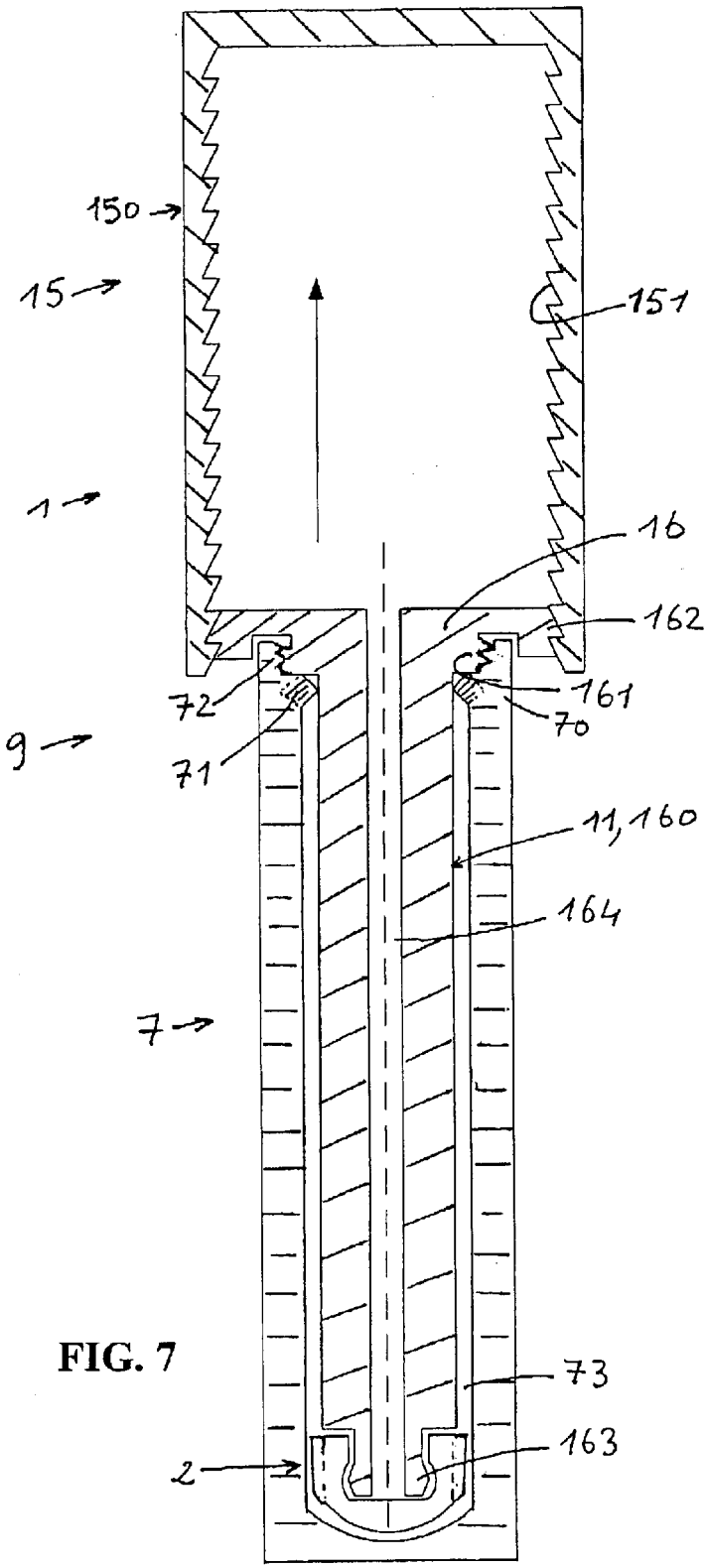
FIG. 7 shows an axial sectional view of another embodiment of the applicator (1) and the distributor (9), in which the gripping means also forms a reservoir (15) into which an insert (16) can be slid to form a piston for the reservoir (15), the insert (16) comprising a pipe (160), the lower end of which forms a spindle for the said mobile part (20).

FIG. 7 illustrates an example of an applicator (1) belonging to this second family of applicators. As can be seen in this figure, the shell (150) comprises a toothed part (151) cooperating with the toothed external edge (162) of the insert (16) forming a piston, such that the insert forming a piston can only move forward inside the shell as the said product is consumed. Obviously, other embodiments of manual transfer means performing analogous functions, and particularly to reduce the internal volume of the gripping means (15) forming a reservoir by manual action by the user, are possible with the invention.

Regardless of the applicator embodiment (1), and as illustrated in all the figures, the said rotation of the said mobile part (20) with respect to the said lower end (14) may be an axial rotation about an axis of rotation (140) that is typically coincident with the said axial direction (112).

However, this is a preference to the extent that the said longitudinal element (11) does not necessarily have an axial direction (112). It may be curved, and in this case there will be no alignment of the axis of rotation (140) with the axial direction (112) of the longitudinal element (11).

According to one variant embodiment of the invention, the said mobile part (20) and the said lower end (14) may cooperate such that the said mobile part (20) forms the said "hub" (3) and the said lower end (14) forms the said "spindle" (4).

Advantageously, as illustrated in FIGS. 1, 6*a*, 6*b* and 7, the said mobile part (20) forming the said hub (3) may comprise a non-through hole (30) such that only the said mobile part (20) is in contact with the said support (8).

According to one variant of the invention, the said mobile part (20) and the said lower end (14) may cooperate such that the said mobile part comprises an upper end (25) forming the said "spindle" (4), while the said lower end (14) forms the said "hub" (3). This variant was illustrated in FIG. 2.

As illustrated in FIGS. 1 to 4*b*, all of the said application means (2) may cooperate with the said lower end (14) while remaining free to rotate with respect to the said lower end (14).

But as illustrated in FIGS. 6*a* and 6*b*, the said application means (2) may comprise a part (21) that is not free to rotate with respect to the said lower end (14), so as to obtain a complementary effect or function, apart from local deposit of the said product.

The said application means (2) may typically be external, cylindrical, tapered or partially spherical, and will have a typically rounded lower end in all cases.

The said application means was shown as having a cylindrical shape in FIGS. 1 to 3 and 7, as having the shape of a cylinder curved on the inside in FIGS. 4*a* and 4*b*, and with a partially spherical shape in FIGS. 6*a* and 6*b*.

Typically, the said application means (2) may be fixed to the said longitudinal element (11) by a click fit means (141, 24), usually an axial click fit as illustrated in all of the figures.

According to the invention, the said application means (2) may comprise a means of transferring or temporarily retaining the said product, typically on its surface but possibly within its body, and typically operating by capillarity.

This transfer or temporary retention means may typically be chosen as either a brush provided with bristles, a cellular foam type material, a fibrous material such as felt or a woven or non woven and/or elastomeric material, a set of reliefs and recesses such as grooves or ribs (23) formed on the said application means (2) itself, the said grooves and ribs possibly being parallel, spiral, diamond cut, or helix with a cylindrical, concave, convex or conical profile.

In practice, all materials, typically in the divided or porous state, or all material geometries that might temporarily retain a product—typically ribs formed on the application means might be suitable, regardless of the physical or physicochemical mechanism involved, these materials or these geometries preferably being adapted to the viscosity or theological properties of the products to be applied.

As can be seen on the right part of FIGS. 1 and 6*b*, the said application means (2) may be fitted with a typically rigid core (26) on the inside, comprising the said click fit means (24), and with the said transfer or temporary retention means (27) on the outside.

However, as shown in FIG. 6, the said application means may be made of a single material and may comprise open cells (28) on the surface for transferring the said product.

According to one variant of the application, the said application means (2) and the said longitudinal element (11) may typically have the same profile, but this is in no way compulsory as illustrated in FIGS. 6*a* and 6*b*.

But in all cases, the said mobile part (20) and the longitudinal element (11) work together to have an axial continuity that prevents the said product from penetrating between the said means and the said spindle with the risk of blocking cooperation between the said means and the said spindle and thus blocking the said rotation, as can be seen in the figures.

As can be seen in all the figures, the said gripping means (13, 15) have a typically cylindrical shape and may comprise an outer shell (132, 150) and an inner insert (133, 16) that is typically threaded, designed to cooperate with the said neck (50, 70) and fixed to the said longitudinal element (11, 160).

As illustrated in FIG. 1, the said insert (133) and the said longitudinal element (11) may form a single piece part.

Figure 3:
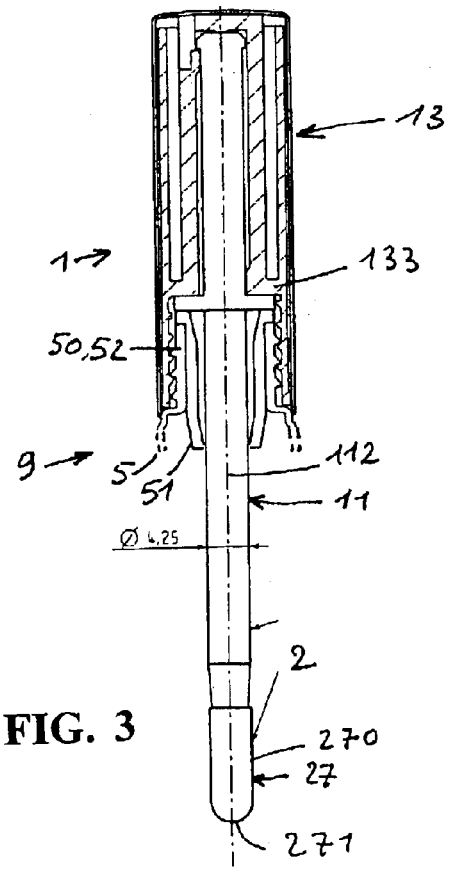

However, as illustrated in FIG. 3, the said insert (133) and the said longitudinal element (11) may form two parts typically fixed together by click fitting or forced insertion.

Figure 2:
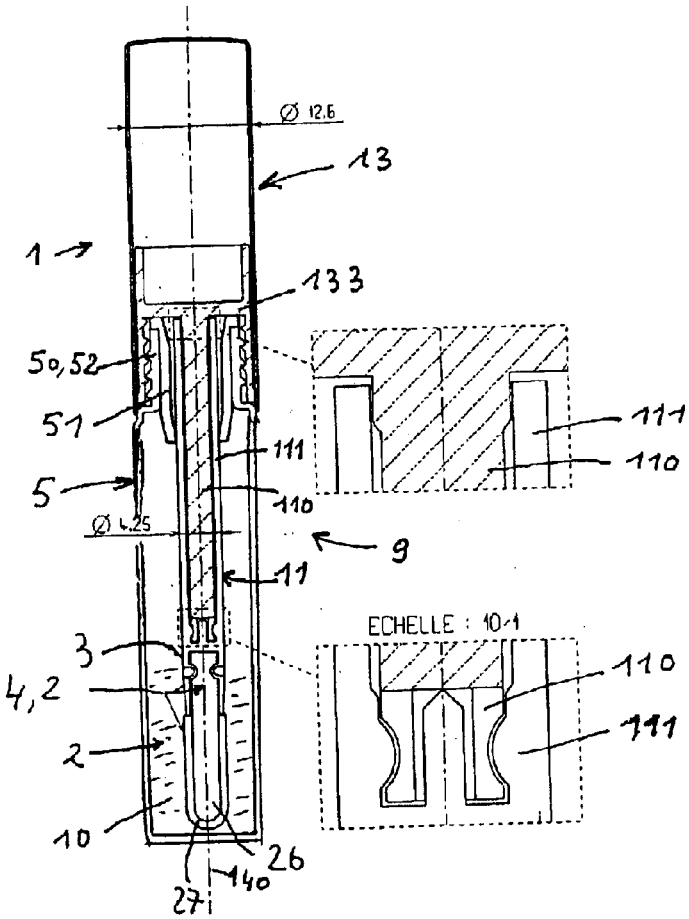

Furthermore, as illustrated in FIG. 2, the said longitudinal element (11) may comprise two coaxial tubular parts typically fixed together by click fitting or forced insertion one into the other, one (110), typically an inner part forming a single piece part with the said insert (133), and the other (111), typically an outer part being fixed at its lower end to the said application means (2, 20).

Preferably, the said gripping means (13, 15), and the said receptacle (5) or the said jacket or case (7) have the same cross-section over some or all of their height, or connect together according to the same cross-section, which may be advantageous aesthetically, as illustrated in FIG. 2.

Another purpose of the invention is use of the distributor (9) according to the invention for sampling of the said product, the quantity of the said product then being small and typically less than 5 $cm^2$.

Example Embodiments

All figures apply to example embodiments.

All parts of applicators (1) and distributors (9), except for transfer and temporary rotation means (27) were made by moulding of plastic parts, that were click fitted or assembled by force as shown in the figures.

For example, the dimensions of the applicators (1) in FIGS. 1 to 3 are shown in the following table:

| | FIG. 1 | FIG. 2 | FIG. 3 |
|---|---|---|---|
| Gripping means diameter | 13.89 mm | 12.6 mm | 12.6 mm |
| Longitudinal element diameter | 4.69 mm | 4.25 mm | 4.25 mm |
| Length | 85 mm | 82 mm | 87 mm |

All sorts of application means (2), typically about 20 mm high (from 10 to 25 mm) were made, and application means like those shown in FIGS. 6*a* and 6*b* were also made with a mobile part (20) and a non-mobile part (21).

Some were made in the same way as cotton swabs, by the application of a fibrous product, for example cotton, on a rigid support or core (26).

Others were made using a spongy or cellular material, also fixed on a rigid core (26).

Finally, others were made using grooves like those shown in FIG. 4*b*, the material used possibly being spongy or cellular.

The applicators made were tested by a users group. In general, it was found that these applicators were smoother in use than applicators according to prior art, they provided a more uniform deposit, and offered a wide range of possible effects and particularly because the mobile part (20) of an applicator (1) may be used through its side part (270) according to the invention, and also through its end according to prior art (271).

List of identifiers

| | |
|---|---|
| Applicator | 1 |
| Product | 10 |
| Longitudinal element | 11 |
| Inner part | 110 |
| Outer part | 111 |
| Axial direction | 112 |
| Upper end | 12 |
| Gripping means - cap cooperates with 5 | 13 |
| Skirt | 130 |
| Thread or click fit groove | 131 |
| Outer shell | 132 |
| Inner insert | 133 |
| Lower end | 14 |
| Rotation spindle for 20 | 140 |
| Click fit means with 24 | 141 |
| Gripping means forming reservoir | 15 |
| Shell | 150 |
| Toothed inner wall with 162 | 151 |
| Mobile insert forming piston for 15, 150 | 16 |
| Longitudinal element with pipe | 160 |
| Thread cooperates with thread 72 of 7 | 161 |
| Toothed outer edge with 151 | 162 |
| Click fit means with 24 | 163 |
| Pipe | 164 |
| Application means | 2 |
| Mobile part | 20 |
| Non-mobile part | 21 |
| Groove | 23 |
| Click fit means with 141, 163 | 24 |
| Upper end | 25 |
| Rigid core | 26 |
| Transfer or temporary retention means | 27 |
| Side part | 270 |
| Lower end | 271 |
| Open cells | 28 |
| Hub | 3 |
| Non-through hole | 30 |
| Spindle | 4 |
| Receptacle forming reservoir cooperating with 13, 131 | 5 |
| Neck | 50 |
| Wiping lip | 51 |
| Thread or click fit groove | 52 |
| Case or jacket cooperating with 16 | 7 |
| Neck | 70 |
| Wiping lip | 71 |
| Thread cooperates with thread 161 | 72 |
| Cavity | 73 |
| Support to be treated | 8 |
| Distributor = 13 + 5 or 15 + 7 | 9 |

What is claimed is:

1. Distributor (9) of a cosmetic product (10) designed to be deposited on a support (8) such as part of the face or finger or toe nails, comprising a body forming a reservoir (5) for the said product (10) and an applicator (1), the said applicator (1) comprising a longitudinal element (11, 160) in the axial direction (112), with a manual gripping means (13, 15) comprising a cap (13) fixed to its one end (12) and a means of application (2) of the said cosmetic product (10)

fixed to the said longitudinal element at its other end (14), at least part (20) of the said application means (2) cooperating with the said other end (14) of the said longitudinal element in rotation, the said part (20) being free to rotate with respect to the said other end (14), the said part (20) of the said application means (2) comprising a means (27) of transferring or temporarily retaining the product, so that manual displacement of the said applicator (1) in order to make a local deposit of the said product on the said support (8) causes rotation of the said mobile part (20) with respect to the said other end (14) and a transfer of the said cosmetic product (10) on the said support (8), applicator (1) in which the said transfer or temporary retention means (27) comprises an end (271) positioned in the axial direction with respect to the said other end (14), such that the said other end (14) does not project beyond the said other end (271), wherein said receptacle comprises a neck (50), provided with a wiping lip (51), the length of the said longitudinal element (11) being adapted to the depth of the said receptacle (5) in order to transfer the said product towards the said application means (2), when the said neck (50) of the said receptacle (5) is closed off by the said cap (13), said application means (2) and said longitudinal element (11) having a continuity of surface and diameter.

2. Distributor according to claim 1, in which the said cap (13) comprises a skirt (130) cooperating with the said neck (50) by screwing or click fitting using a screwing thread or a click fit rib or groove (131, 52).

3. Distributor according to claim 1, in which the said manual gripping means forms a reservoir (15) for the said product (10) in which the said longitudinal element (160) comprises a pipe (164) opening up into the said reservoir so as to supply product (10) to the said application means (2) through a manual transfer means, the said body forming a case or jacket (7) that protects the said longitudinal element (160) and the said application means (2), and forms a cavity (73) that may enable transfer of a predetermined and limited quantity of the said product (10) from the said reservoir (15) to the said application means (2).

4. Distributor according to claim 3, in which the said reservoir (15) comprises an outer shell (150) containing the said product, with a cylindrical shape, the said shell (150) comprising an opening closed off by an insert (16) fixed to the said longitudinal element and forming a piston for the said shell (150), the said insert cooperating in a fixed manner with the said case (7), through its neck (70) so as to form the said manual transfer mean by manual displacement of the said longitudinal element (160) or the said case (7) in the axial direction.

5. Distributor according to claim 1, in which the said rotation of the said mobile part (20) with respect to the said other end (14) is an axial rotation about an axis of rotation (140) that is coincident with an axial direction (112).

6. Distributor according to claim 1, in which the said mobile part (20) and the said other end (14) cooperate such that the said mobile part (20) forms a hub (3) and the said other end (14) forms a spindle (4).

7. Distributor according to claim 6, in which the said mobile part (20) forming the said hub (3) comprises a non-through hole (30) such that only the said mobile part (20) is in contact with the said support (8).

8. Distributor according to claim 1, in which the said mobile part (20) and the said other end (14) cooperate such that the said mobile part comprises an upper end (25) forming a spindle (4), while the said other end (14) forms a hub (3).

9. Distributor according to claim 1, in which all of the said application means (2) cooperate with the said other end (14) while remaining free to rotate with respect to the said other end (14).

10. Distributor according to claim 1, in which the said application means (2) comprises a part (21) that is not free to rotate with respect to the said other end (14), so as to obtain a complementary effect or function, apart from local deposit of the said product.

11. Distributor according to claim 1, in which the said application means (2) has a cylindrical, tapered or partially spherical external shape, and has a rounded lower end in all cases.

12. Distributor according to claim 1, in which the said application means (2) is fixed to the said longitudinal element (11) by a click fit means (141, 24).

13. Distributor according to claim 1, in which the said transfer or temporary retention means (27) is either a brush provided with bristles, a cellular foam type material, a fibrous material such as felt or a woven or non-woven and/or elastomeric material, a set of reliefs and recesses such as grooves or ribs (23) formed on the said application means (2) itself, the said grooves and ribs being parallel, spiral, diamond cut, or helix with a cylindrical, concave, convex or conical profile.

14. Distributor according to claim 1, in which the said application means (2) is fitted with a rigid core (26) comprising a click fit means (24) on the inside, and with transfer or temporary retention means (27) on the outside.

15. Distributor according to claim 1, in which the said application means (2) and the said longitudinal element (11) have the same profile.

16. Distributor according to claim 1, in which the said gripping means (13, 15) has a cylindrical shape and comprises an outer shell (132, 150) and an inner insert (133, 16) that is threaded, designed to cooperate with the said neck (50, 70) and fixed to the said longitudinal element (11, 160).

17. Distributor according to claim 16, in which the said insert (133) and the said longitudinal element (11) for a single piece part.

18. Distributor according to claim 17, in which the said insert (133) and the said longitudinal element (11) form two parts fixed together by click fitting or forced insertion.

19. Distributor according to claim 18, in which the said longitudinal element (11) comprises two coaxial tubular parts fixed together by click fitting or forced insertion one into the other, one (110), an inner part forming a single piece part with the said insert (133), and the other (111), an outer part fixed at its lower end to the said application means (2, 20).

20. Distributor according to claim 1, in which the said gripping means (13, 13) and the said receptacle (5) or the said jacket or case (7) have the same cross-section over some or all of their height, or connect together according to the same cross-section.

21. Use of the said distributor according to claim 1 for sampling of the said product, the quantity of the said product then being small and less than 5 $cm^2$.

* * * * *